US005580012A

United States Patent [19]

Soltysiak

[11] Patent Number: 5,580,012

[45] Date of Patent: Dec. 3, 1996

[54] SHINGLED LINERLESS LABEL ROLLS

[75] Inventor: John R. Soltysiak, Blasdell, N.Y.

[73] Assignee: Moore Business Forms, Inc., Grand Island, N.Y.

[21] Appl. No.: 405,940

[22] Filed: Mar. 17, 1995

[51] Int. Cl.[6] ..... B32B 31/18

[52] U.S. Cl. ..... 242/528; 156/248

[58] Field of Search ..... 242/527, 527.1, 242/527.3, 527.4, 528, 534, 534.2, 538, 538.1, 538.2, 547; 156/184, 190, 246, 248, 250, 260, 264, 289, 578

[56] References Cited

U.S. PATENT DOCUMENTS

| | | | |
|---|---|---|---|
| 3,704,835 | 12/1972 | Harley | 242/527.1 |
| 3,991,538 | 11/1976 | Finn et al. . | |
| 4,005,830 | 2/1977 | Smith . | |
| 4,111,377 | 9/1978 | Tetro et al. | 242/527.4 |
| 4,142,691 | 3/1979 | Watton . | |
| 4,245,832 | 1/1981 | Klenk et al. . | |
| 4,434,948 | 3/1984 | Feldkamper . | |
| 4,589,603 | 5/1986 | Müller | 242/528 |
| 4,688,368 | 8/1987 | Honegger . | |
| 4,741,487 | 5/1988 | Balass . | |
| 4,840,694 | 6/1989 | Brookman et al. | 242/528 |
| 4,909,015 | 3/1990 | Leu | 242/528 |
| 4,927,129 | 5/1990 | Merkli | 242/528 |
| 4,993,043 | 6/1990 | Instance | 156/248 |
| 5,021,110 | 6/1991 | Kobayashi | 156/260 |
| 5,271,787 | 12/1993 | Hoffmann et al. | 156/250 |
| 5,470,418 | 11/1995 | Instance | 156/248 |

*Primary Examiner*—John P. Darling
*Attorney, Agent, or Firm*—Nixon & Vanderhye P.C.

[57] ABSTRACT

A roll of shingled, distinct linerless labels is produced by forming a plurality of the distinct labels (each having a substrate, a release coated first face, and a pressure sensitive adhesive coated second face) by transporting a web at a first speed, automatically severing distinct labels from the web, and after severing accelerating the labels to a second, faster, speed so that the labels are conveyed separated and distinct from each other in a first direction. Using a standard rewind the linerless labels are taken up on a formed roll of shingled linerless labels by rotating the roll with an initial tangential velocity component in the first direction at a third speed, slower than the first speed, so that the distinct labels overlap with the second face of each newly added label engaging the first face of at least one label already on the formed roll. The roll shaft is mounted on at least one articulating arm. The build up of labels on the roll is sensed by a sensor, which controls pneumatic cylinders for pivoting the articulating arm about an axis parallel to the roll axis to ensure that the top of the roll is in alignment with the labels when discharged by a transport conveyor. Each label is pressed onto the roll immediately after being added by a non-driven surface belt mounted by idler rollers. The roll is rotated at a speed such that the initial tangential velocity of each added label is at the third speed.

23 Claims, 2 Drawing Sheets

SHINGLED LINERLESS LABEL ROLLS

BACKGROUND AND SUMMARY OF THE INVENTION

Because of environmental and other advantages associated with them, linerless labels are becoming increasingly more popular. Linerless labels are typically sold in rolls of continuous labels, with or without perforations or other lines of weakness between the labels, or in stacks. Each type of configuration has its own associated advantages and disadvantages, one of the most significant disadvantages associated with conventional rolls of linerless labels being the need to have a dispenser which can facilitate separation of the labels as they are being dispensed.

According to the present invention a method and apparatus are provided for forming a roll of linerless labels that has a different configuration than conventional rolls. The rolls formed according to the invention are composed of shingled, distinct linerless labels. In this configuration most of the advantages of a roll are still available but there is no necessity to provide a device for facilitating separation of the labels where dispensed since the labels are already distinct from each other.

The apparatus according to the present invention uses simple primarily standard components to form a roll of shingled, distinct linerless labels. Basically a standard rewind unit may be used in association with a standard cut off unit, with various mechanisms associated with the take-up unit to adjust its position, and with a transport conveyor operating at a particular speed between the cut off and the take-up.

According to one aspect of the present invention a method of forming a roll of shingled, distinct linerless labels is provided. The method comprises the following steps: (a) Forming a plurality of distinct linerless labels, each label comprising a substrate, a release coated first face, and a pressure sensitive adhesive coated second face. (b) Conveying the linerless labels substantially separated and distinct from each other in a first direction at a first speed. And, (c) taking up the linerless labels from step (b) on a formed roll of shingled linerless labels, by rotating the roll of linerless labels with an initial tangential velocity component in the first direction and at a second speed, slower than the first speed, so that the distinct labels overlap with the second face of each newly added linerless label engaging the first face of at least one linerless label already on the formed roll.

Typically the formed roll is rotatable about a substantially horizontal axis and has a periphery at which labels are added to the formed roll. Step (b) is practiced in a substantially linear and horizontal first direction at a first level, and there is the further step (d) of automatically moving the roll of shingled labels in response to the size of the roll so that substantially the highest point of the periphery of the formed roll is substantially at the first level. There is also typically the further step (e) of pressing each linerless label onto the formed roll immediately after each label is brought into contact with the periphery thereof.

Step (a) is typically practiced by transporting a web at a third speed, slower than the first speed and faster than the second speed, substantially in the first direction, automatically severing distinct labels from the web, and after severing accelerating the distinct linerless labels to the first speed. Step (d) is typically practiced by mounting the formed roll on a shaft, in turn mounted on at least one articulating arm mounted for pivotal movement at a pivot point remote from the shaft, sensing the highest point of the periphery of the formed roll, and pivoting the arm about the pivot point in response to the sensing. Typically the first speed is approximately 25% faster than the third speed, and the speed ratio of the second and third speeds is adjusted to provide shingled overlap of linerless labels taken up on the formed roll therebetween of about 10–90%.

According to another aspect of the present invention apparatus for forming a roll of shingled distinct elements is provided (preferably linerless labels). The apparatus comprises: A roll shaft. A pivot shaft substantially parallel to the roll shaft. At least one articulating arm connected at a first portion thereof to the roll shaft and at a second portion thereof, remote from the first portion, to the pivot shaft. Means for rotating the roll shaft about an axis of rotation. Means for selectively holding the articulating arm at a position to which it has been moved, or moving it to other positions by pivoting the arm about the pivot shaft. And, pressing means positioned generally in alignment with and adjacent the articulating arm and substantially between the roll shaft and the pivot shaft and for pressing individual distinct elements into a formed roll of shingled distinct elements.

The pressing means preferably comprises a non-driven surface belt mounted on a plurality of idler rollers substantially to the roll shaft and pivot shaft. Alternatively the pressing means could comprise spring pressed rollers, a relatively stationary smooth low friction surface, or other devices. The means selectively holding or moving the at least one articulating arm preferably comprises at least one piston and cylinder assembly, either hydraulic or pneumatic, most preferably a pair of pneumatic cylinders controlled by a pneumatic controller. Alternatively the arm holding or moving means may comprise a rotating or linear cam arrangement, a cog wheel, or other types of linear actuators pivoted to the articulating arm.

The roll shaft is rotated about an axis of rotation by a DC motor, or pneumatic, hydraulic, or other power source motors. Typically the motor is mounted on and movable with the articulating arm.

The apparatus typically further comprises means for delivering the distinct elements, one at a time, separated and distinct from each other between the roll shaft and the pressing means. The delivery means typically comprises a driven transport conveyor belt. The apparatus typically further comprises means for severing a web into individual distinct elements positioned adjacent the delivery means, the severing means for example comprising bursters, conventional guillotine blade arrangements, or a rotating cylinder with one or more blades cooperating with an anvil roll.

The apparatus further comprises first sensing means (e.g. an optical sensor) for sensing the position of elements formed on the roll shaft, second sensing means for sensing the speed of the web prior to the severing means, and a controller (e.g. computer) receiving input from the first and second sensing means, the controller controlling the means for selectively holding or moving the articulating arm in response to the first sensing means, and for controlling the means for rotating the roll shaft about an axis of rotation in response to the second sensing means.

According to yet another aspect of the present invention apparatus for forming linerless labels into a roll of shingled distinct linerless labels, each label comprising a substrate, a release coated first face, and a pressure sensitive adhesive coated second face, is so provided. The apparatus comprises the following elements: A roll shaft. A plurality of shingled distinct linerless labels comprising a formed roll on the roll shaft, the second face of each label closer to the roll shaft than the first face thereof. A pivot shaft substantially parallel to the roll shaft. At least one articulating arm connected at a first portion thereof to the roll shaft and at a second portion thereof, remote from the first portion, to the pivot shaft. And, means for rotating the roll shaft about an axis of rotation. The components comprising this apparatus may be as described above in their preferred embodiments.

It is the primary object of the present invention to provide a method and apparatus effecting the simple and efficient formation of a roll of shingled, distinct linerless labels, or the like. This and other objects of the invention will become clear from an inspection of the detailed description of the invention and from the appended claims.

DETAILED DESCRIPTION OF THE DRAWINGS

Figure 1:
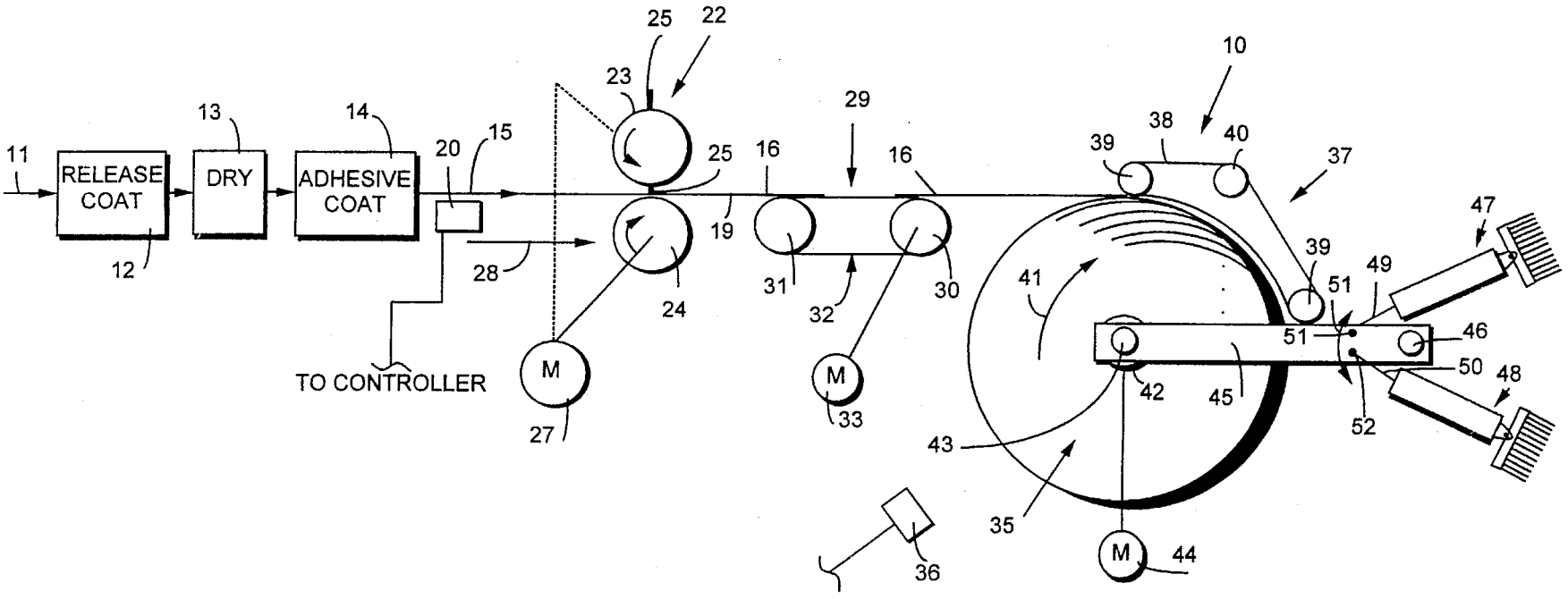
FIG. 1 is a schematic side view of exemplary apparatus according to the present invention for practicing an exemplary method according to the present invention.

Exemplary apparatus for forming a roll of shingled distinct elements, preferably shingled distinct linerless labels, according to the present invention is shown generally by reference numeral 10 in FIG. 1. In a preferred embodiment according to the present invention a web 11 of substrate material for conventional linerless labels, such as paper or plastic, is formed into a web of linerless labels utilizing conventional release coat station 12, dry station 13, and adhesive coat station 14, the linerless label web 15 being produced.

Figure 2:
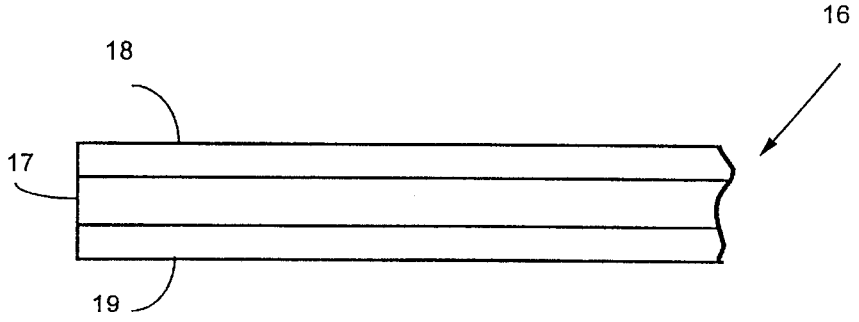
FIG. 2 is a side schematic enlarged view of an individual label taken up utilizing the apparatus of FIG. 1.

At the adhesive coat station 14 a coating of pressure sensitive adhesive (either permanent, removable, or repositional) is applied to the bottom face of the web 11 while at station 12 a conventional adhesive release material, such as a silicone coating, is applied to the top face of the web substrate 11. Of course other conventional steps may be utilized, such as particular drying or curing steps (e.g. UV curing steps), or additional coating steps, such as for application of tie coats, thermosensitive layers, or the like, depending upon the desired labels 16 ultimately produced. FIG. 2 shows (greatly exaggerated in size for clarity of illustration) an exemplary label 16 according to the invention including a substrate 17, (e.g. paper) a release coating 18 on the top (first) face thereof, and a pressure sensitive adhesive coating 19 on the bottom (second) face thereof.

All of the coating and like steps/stages 12, 13, 14 are desirably practiced on a conventional line, such as a web press, and the label web 15 may be imaged (e.g. imprinted) on the top (first) face thereof either before or after application of the release coat 18 at stage 12. To provide cooperation with other components as will be hereinafter described a conventional sensor 20 may also be provided for sensing the speed of the web 11/15. The sensor 20 may be of any conventional type.

The individual labels 16 are preferably formed utilizing means 22 for severing a web 15 into individual distinct labels 16. The severing means 22 may comprise a wide variety of conventional web severing devices including bursters, guillotine cutters, and the like. In the preferred embodiment illustrated in FIG. 1 a standard cut off unit is utilized comprising a cutter roller 23 cooperating with an anvil roller 24, the cutter roller 23 having one or more blades 25 extending substantially radially therefrom. The rolls 23, 24 are powered for rotation in the directions indicated by the arrows in FIG. 1 by an electric motor 27 or the like. The speed of rotation of the rolls 23, 24, and the positioning of the blades 25 on the roller 23, control the length of the labels 16 in the first direction of movement 28, which is typically a linear direction.

Just adjacent and downstream (in the first direction 28) of the web severing means 22 is means for delivering the distinct labels 16, one at a time, separated and distinct from each other (as seen in FIG. 1) in the direction 28. The delivery means 29 may comprise a wide variety of conventional structures such as all types of conveyors, rollers, or the like. In the preferred embodiment illustrated in FIG. 1 the delivery means 29 comprises a pair of rollers 30, 31, with a conveyor belt 32 wrapped therearound, the roller 30 being driven by an electric motor 33 or the like. Typically the motor 33 drives the delivery means 29 at a speed higher than the line speed of the web 15 so as to impart the desired separation between individual labels 16 downstream of the severing means 22.

A formed roll of shingled, distinct linerless labels 16 is shown schematically at 35 in FIG. 1. A sensor 36 is provided for sensing the size (typically diameter) of the roll 35 for control purposes hereinafter described. The sensing means 36 may comprise any conventional sensor that is capable of performing this function, such as an optical sensor, and may be positioned with respect to roll 35 as illustrated in FIG. 1.

Individual labels 16 as they are fed to the top periphery of the roll 35 are preferably smoothed or pressed into place on the periphery with the second face 19 thereof engaging the release face 18 of at least one underlying label in the roll 35, typically two labels. To accomplish this purpose pressing means 37 are provided downstream (in the direction 28) of the delivery means 29 while the pressing means 37 may comprise a wide variety of structures, such as spring pressed rollers, or a smooth relatively friction free relatively stationary surface, in the preferred embodiment illustrated in FIG. 1 it comprises a surface belt 38 that is wrapped around idler rollers 39, 40 as illustrated in FIG. 1, the belt 38 moving and the rollers 39, 40 turning as the belt 38 contacts and smooths or presses down labels 16 as they are being driven by rotation of the roll 35 in the direction of arrow 41.

Associated with the formed roll 35 is a roll shaft 43 which ultimately engages and rotates (in direction 41) the roll 35, for example through a core 42. The core 42 is constructed so that it has a peripheral surface which is of adhesive release material so that the initial label 16 forming the roll 35 may releasably adhere thereto. The roll shaft 43 is powered for rotation in the direction of arrow 41 about an axis extending through the shaft 43 by the rotating means 44. The rotating means 44 preferably comprises a DC motor, but may comprise a pneumatic, hydraulic, or like conventional device for effecting rotation. Rotation is preferably continuous, but may be in steps. Desirably the motor 44 is mounted on an articulating arm 45 or a like structure which is stationary with respect to the roll 35, but is otherwise movable to accommodate the build up of the labels 16 on the roll 35 (thus an increase in diameter of the roll 35).

At least one articulating arm 45 is provided for mounting the roll shaft 43. Preferably two arms 45 are provided, one on each side of the roll 35 and having a bearing opening therein for receipt of the roll shaft 43 end. The arm 45 is mounted for pivotal movement about a pivot shaft 46 which is remote from the roll shaft 43 and substantially parallel thereto (as well as parallel to the rolls 23, 24, 30, 31, 39 and 40). The shaft 46 is also mounted to a stationary structure (not shown).

Figure 3:
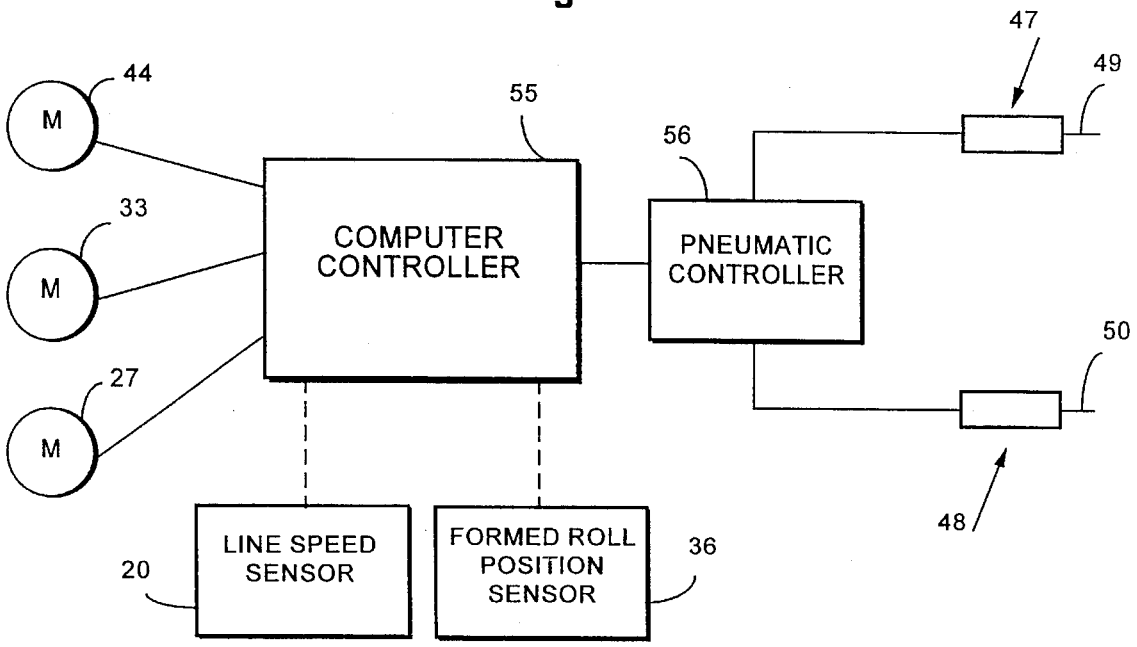
FIG. 3 is a control schematic for the apparatus of FIG. 1.

Means—shown generally by reference numerals 47 through 50 in FIGS. 1 and 3—are provided for selectively holding the articulating arm 45 at a position to which it has been moved, or moving it to other positions by pivoting the at least one arm 45 about the pivot shaft 46. The selectively holding or moving means may comprise a wide variety of structures, such as hydraulic cylinder assemblies, rotating or linear cams for operatively engaging the arm 45, or a wide variety of other types of linear actuators. In the preferred embodiment illustrated in FIGS. 1 and 3 two pneumatic cylinder assemblies 47, 48 are provided each having a pivot rod 49, 50 which is pivoted—as indicated at 51 and 52, respectively, in FIG. 1—to the articulating arm 45 (and pivoted at the opposite ends thereof (not shown) to a stationary structure).

As seen in FIG. 3 preferably a controller 55—such as a computer controller—is provided for receiving input from the sensors 20, 36 and for controlling the motors 27, 33, 44, and—through a pneumatic controller 56—the pneumatic cylinder assemblies 47, 48.

In an exemplary method of forming the roll 35 of shingled distinct linerless labels according to the invention, the substrate 17 is adhesive and release coated, and dried, to produce the linerless label web 15 traveling in the direction 28 at a first speed sensed by the line speed sensor 20. Motor 27 rotates the rollers 23, 24 to cut individual labels 16 from the linerless label web 15, the labels 16 passing in the direction 28 at a first level (or height) to the delivery means 29. Motor 33 powers the delivery means 29—in particular the belt 32—so that it accelerates each label 16 moving in the direction 28 immediately after the label 16 is detached from the web 15 by the severing means 22, the label 16 having an initial tangential velocity component in the first direction 28 at the top of the roll 35. The speed at which the delivery means 29 is operated is the second speed, which is higher than the first speed 15, and typically about 25% higher, so as to introduce sufficient spacing between the distinct labels 16.

Once a label 16 engages the top surface of the formed roll 35—the position of which is sensed by the size sensor 36—the bottom, adhesive, face 19 thereof comes into contact with the release material 18 on the exterior of one or more labels 16 already in the roll 35. At approximately the same time, or shortly thereafter, the newly added label 16 release coated surface 18 comes in contact with the surface belt 38, and as the roll 35 is being powered in the direction 41 by the motor 44, the newly added label 16 is being pressed into engagement with the rest of the labels by the belt 38, which moves along with the newly added label 16 in a circular arc between the rolls 39. The motor 44 drives the shaft 43, and thus the roll 35, in the direction 41 so that the tangential velocity at the top of the roll 35, where each new label 16 is added, is at a third speed which is slower than both the speed of web 15 and the speed of the transport conveyor 29 so that the overlapping, shingled, configuration of the labels 16 on the roll 35 is provided. The ratio of the tangential speed of the new label 16 to the manufacturing line speed (of the web 15) is adjustable to provide different shingled overlap, typically between 10–90%.

As the roll 35 diameter increases, this is sensed by the sensor 36 and fed to the controller 55. In order to maintain the top of the roll 35 even with the transport conveyor 29 height, the controller 55—through the pneumatic controller 56—controls the pneumatic cylinders 47, 48 to pivot the arm 45 about the pivot shaft 46. For example for the embodiment illustrated in FIG. 1, as the diameter of the roll 35 increases, the piston rod 49 will be extended from the pneumatic cylinder assembly 47 while the piston rod 50 is retracted with respect to the pneumatic piston assembly 48.

Once a roll of desired or maximum size has been produced, the various components are shut down, the roll 35 (e.g. the entire core 42) is removed so that it is no longer in operative association with the roll shaft 43 and a new core 42 put in its place. The sensor 36 senses the low position of the articulating arm 45 and through the controller 55 controls the cylinder assemblies 47, 48 so that the arm 45 is moved so that the core 42 is at about the level of the transport conveyor 29, and then operation starts again. The computer controller 55 receives input from the sensors 20, 36, as well as any other sensors that are desired, and controls the speed of operation of the motors 27, 33, 44—as well as the line speed (if desired)—to get the desired results.

It will thus be seen that according to the present invention a simple yet effective method and apparatus have been provided for the forming of a roll of shingled distinct elements, preferably shingled, distinct, linerless labels. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of forming a roll of shingled, distinct, linerless labels, comprising the steps of:

(a) forming a plurality of distinct linerless labels, each label comprising a substrate, a release coated first face, and a pressure sensitive adhesive coated second face;

(b) conveying the linerless labels substantially separated and distinct from each other in a first direction at a first speed; and (c) taking up the linerless labels from step (b) on a formed roll of shingled linerless labels, by rotating the roll of linerless labels with an initial tangential velocity component in the first direction and at a second speed, slower than the first speed, so that the distinct labels overlap with the second face of each newly added linerless label engaging the first face of at least one linerless label already on the formed roll.

2. A method as recited in claim 1 wherein the formed roll is rotatable about a substantially horizontal axis, and has a periphery at which labels are added to the formed roll; and wherein step (b) is practiced in a substantially linear and horizontal first direction at a first level; and comprising the further step (d) of automatically moving the roll of shingled labels in response to the size of the roll so that substantially the highest point of the periphery of the formed roll is substantially at the first level.

3. A method as recited in claim 2 comprising the further step (e) of pressing each linerless label onto the formed roll immediately after each label is brought into contact with the periphery thereof.

4. A method as recited in claim 3 wherein step (a) is practiced by transporting a web at a third speed, slower than the first speed and faster than the second speed, substantially in the first direction, automatically severing distinct labels from the web, and after severing accelerating the distinct linerless labels to the first speed.

5. A method as recited in claim 4 wherein step (d) is practiced by mounting the formed roll on a shaft, in turn mounted on at least one articulating arm mounted for pivotal movement at a pivot point remote from the shaft, sensing the highest point of the periphery of the formed roll, and pivoting the arm about the pivot point in response to said sensing.

6. A method as recited in claim 5 wherein the first speed is approximately twenty five percent faster than the third speed, and wherein the speed ratio of the second and third speeds is adjusted to provide shingled overlap of linerless labels taken up on the formed roll that are between about 10–90%.

7. A method as recited in claim 2 wherein step (d) is practiced by mounting the formed roll on a shaft, in turn mounted on at least one articulating arm mounted for pivotal movement at a pivot point remote from the shaft, sensing the highest point of the periphery of the formed roll, and pivoting the arm about the pivot point in response to said sensing.

8. A method as recited in claim 1 wherein step (a) is practiced by transporting the web at a third speed, slower than the first speed and faster than the second speed, substantially in the first direction, and automatically severing distinct labels from the web, and after severing accelerating the distinct linerless labels to the first speed.

9. A method as recited in claim 7 wherein the first speed is approximately twenty five percent faster than the third speed, and wherein the speed ratio of the second and third speeds is adjusted to provide shingled overlap of linerless labels taken up on the formed roll that are between about 10–90%.

10. A method as recited in claim 1 comprising the further step (e) of pressing each linerless label onto the formed roll immediately after each label is brought into contact with the periphery thereof.

11. Apparatus for forming a roll of shingled distinct elements, comprising:

a roll shaft;

a pivot shaft substantially parallel to said roll shaft;

at least one articulating arm connected at a first portion thereof to said roll shaft and at a second portion thereof, remote from said first portion, to said pivot shaft;

means for rotating said roll shaft about an axis of rotation;

at least one piston and cylinder assembly for selectively holding said articulating arm at a position to which it has been moved, or moving it to other positions by pivoting said arm about said pivot shaft; and pressing means positioned generally in alignment with and adjacent said articulating arm and substantially between said roll shaft and said pivot shaft and for pressing individual distinct elements into a formed roll of shingled distinct elements.

12. Apparatus as recited in claim 11 further comprising means for delivering the distinct elements, one at a time, separated and distinct from each other, between said roll shaft and said pressing means; and means for severing a web into individual distinct elements, positioned adjacent said delivering means.

13. Apparatus as recited in claim 12 wherein said pressing means comprises a non-driven surface belt mounted on a plurality of idler rollers substantially parallel to said roll shaft and said pivot shaft.

14. Apparatus as recited in claim 11 further comprising first sensing means for sensing the position of elements formed on said roll shaft, and a controller receiving input from said first sensing means, said controller controlling said means for selectively holding or moving said articulating arm in response to said first sensing means.

15. Apparatus as recited in claim 11 further comprising means for delivering the distinct elements, one at a time, separated and distinct from each other, between said roll shaft and said pressing means, and means for severing a web into individual distinct linerless labels, positioned adjacent said delivering means.

16. Apparatus for forming a roll of shingled distinct elements, comprising:

a roll shaft;

a pivot shaft substantially parallel to said roll shaft;

at least one articulating arm connected at a first portion thereof to said roll shaft and at a second portion thereof, remote from said first portion, to said pivot shaft;

means for rotating said roll shaft about an axis of rotation;

means for selectively holding said articulating arm at a position to which it has been moved, or moving it to other positions by pivoting said arm about said pivot shaft;

pressing means positioned generally in alignment with and adjacent said articulating arm and substantially between said roll shaft and said pivot shaft and for pressing individual distinct elements into a formed roll of shingled distinct elements;

means for delivering the distinct elements, one at a time, separated and distinct from each other, between said roll shaft and said pressing means; and means for severing a web into individual distinct elements, positioned adjacent said delivering means.

17. Apparatus as recited in claim 16 further comprising first sensing means for sensing the position of elements formed on said roll shaft, second sensing means for sensing the speed of the web prior to said severing means; and a controller receiving input from said first and second sensing means, said controller controlling said means for selectively holding or moving said articulating arm in response to said first sensing means, and for controlling said means for rotating said roll shaft about an axis of rotation in response to said second sensing means.

18. Apparatus for forming a roll of shingled distinct elements, comprising:

a roll shaft;

a pivot shaft substantially parallel to said roll shaft;

at least one articulating arm connected at a first portion thereof to said roll shaft and at a second portion thereof, remote from said first portion, to said pivot shaft;

means for rotating said roll shaft about an axis of rotation;

means for selectively holding said articulating arm at a position to which it has been moved, or moving it to other positions by pivoting said arm about said pivot shaft;

pressing means positioned generally in alignment with and adjacent said articulating arm and substantially between said roll shaft and said pivot shaft and for pressing individual distinct elements into a formed roll of shingled distinct elements; and means for delivering the distinct elements, one at a time, separated and distinct from each other, between said roll shaft and said pressing means; and said pressing means comprises a non-driven surface belt mounted on a plurality of idler rollers substantially parallel to said roll shaft and said pivot shaft.

19. Apparatus for forming linerless labels into a roll of shingled distinct linerless labels, each label comprising a substrate, a release coated first face, and a pressure sensitive adhesive coated second face; said apparatus comprising:

a roll shaft;

a plurality of shingled distinct linerless labels comprising a formed roll on said roll shaft, the second face of each label closer to said roll shaft than the first face thereof;

a pivot shaft substantially parallel to said roll shaft;

at least one articulating arm connected at a first portion thereof to said roll shaft and at a second portion thereof, remote from said first portion, to said pivot shaft; and means for rotating said roll shaft about an axis of rotation.

20. Apparatus as recited in claim 19 further comprising means for selectively holding said articulating arm at a position to which it has been moved, or moving it to other positions by pivoting said arm about said pivot shaft; and pressing means positioned generally in alignment with and adjacent said articulating arm and substantially between said roll shaft and said pivot shaft and for pressing individual linerless labels when first added to said formed roll into contact with other labels on said formed roll.

21. Apparatus as recited in claim 20 wherein said pressing means comprises a non-driven surface belt mounted on a plurality of idler rollers substantially parallel to said roll shaft and said pivot shaft; and wherein said means for selectively holding or moving said at least one articulating arm comprises at least one piston and cylinder assembly.

22. Apparatus as recited in claim 20 further comprising first sensing means for sensing the size of said formed roll of linerless labels on said roll shaft, and a controller receiving input from said first sensing means, said controller controlling said means for selectively holding or moving said articulating arm in response to said first sensing means.

23. Apparatus for forming a roll of shingled distinct elements, comprising:

a roll shaft;

a pivot shaft substantially parallel to said roll shaft;

at least one articulating arm connected at a first portion thereof to said roll shaft and at a second portion thereof, remote from said first portion, to said pivot shaft;

means for rotating said roll shaft about an axis of rotation;

means for selectively holding said articulating arm at a position to which it has been moved, or moving it to other positions by pivoting said arm about said pivot shaft;

pressing means positioned generally in alignment with and adjacent said articulating arm and substantially between said roll shaft and said pivot shaft and for pressing individual distinct elements into a formed roll of shingled distinct elements; and first sensing means for sensing the position of elements formed on said roll shaft, and a controller receiving input from said first sensing means, said controller controlling said means for selectively holding or moving said articulating arm in response to said first sensing means.

* * * * *